US010980320B2

(12) United States Patent
Voumard

(10) Patent No.: US 10,980,320 B2
(45) Date of Patent: Apr. 20, 2021

(54) WATCH CASE WITH MOBILE HORNS

(71) Applicant: Carlo Ferrara SA, Corgémont (CH)

(72) Inventor: Martial Voumard, Tramelan (CH)

(73) Assignee: Carlo Ferrara SA, Corgémont (FR)

( * ) Notice: Subject to any disclaimer, the term of this patent is extended or adjusted under 35 U.S.C. 154(b) by 283 days.

(21) Appl. No.: 16/104,767

(22) Filed: Aug. 17, 2018

(65) Prior Publication Data

US 2019/0069646 A1 Mar. 7, 2019

(30) Foreign Application Priority Data

Sep. 1, 2017 (CH) ..... 01090/17

(51) Int. Cl.

| | |
|---|---|
| ***A44C 5/14*** | (2006.01) |
| ***G04B 37/00*** | (2006.01) |
| ***G04B 37/14*** | (2006.01) |

(52) U.S. Cl.

CPC ..... *A44C 5/147* (2013.01); *G04B 37/0008* (2013.01); *G04B 37/1486* (2013.01); *G04B 37/1493* (2013.01)

(58) Field of Classification Search

CPC ..... A44C 5/147; G04B 37/0008; G04B 37/1486; G04B 37/1493; G04B 37/0427

USPC ..... 368/281–282

See application file for complete search history.

(56) References Cited

U.S. PATENT DOCUMENTS

| | | | | |
|---|---|---|---|---|
| 7,703,974 | B2 * | 4/2010 | Bouille | G04B 37/1486 368/281 |
| 8,256,952 | B2 | 9/2012 | Loiseau | |
| 8,790,004 | B2 * | 7/2014 | Chatelain | G04B 37/1486 368/282 |
| 9,274,506 | B2 * | 3/2016 | Lu | G04G 17/083 |
| 10,058,148 | B1 * | 8/2018 | Wittenberg | A44C 5/2057 |
| 10,058,149 | B1 * | 8/2018 | Wittenberg | A44C 5/2057 |
| 2009/0225633 | A1 | 9/2009 | Lepine | |

FOREIGN PATENT DOCUMENTS

| | | | |
|---|---|---|---|
| CH | 321188 | A | 4/1957 |
| CH | 355094 | A | 6/1961 |
| CH | 697598 | B1 | 12/2008 |
| CH | 698787 | B1 | 10/2009 |
| CH | 701221 | A1 | 12/2010 |
| CH | 703260 | A2 | 9/2013 |
| EP | 0400206 | A1 | 12/1990 |
| EP | 0886196 | A2 | 12/1998 |
| EP | 902641 | A1 | 3/2008 |

(Continued)

OTHER PUBLICATIONS

Search Report for Swiss Application No. CH 10902017, dated Apr. 24, 2018, 3 pages.

*Primary Examiner* — Edwin A. Leon

(74) *Attorney, Agent, or Firm* — Blank Rome LLP

(57) ABSTRACT

Watch case (1) having a middle (2) provided with a blind hole (20); a first mobile horn (3) for fastening a strand of a bracelet, and provided with a through-hole (33); a first elastic element (31) exerting a force on the horn (3) that tends to push it back into a position with a widened lug distance (d); a push-button (5) traversing said through-hole (33) and engaged in the blind hole (20) in the middle, arranged so as to be able to slide between a locked position, in which the push-button (5) blocks the displacement of the horn (3), and a released position in which the displacement of the horn (3) into pushed-back position is possible, a second elastic element (52) exerting a force on the push-button (5) to push it hack into the locked position.

6 Claims, 3 Drawing Sheets

(56) References Cited

FOREIGN PATENT DOCUMENTS

| | | | |
|---|---|---|---|
| EP | 2431825 | A1 | 3/2012 |
| FR | 3004898 | B1 | 6/2015 |
| FR | 3021128 | A1 | 11/2015 |
| WO | WO-2004/023221 | A1 | 3/2004 |
| WO | WO-2009/030984 | A1 | 3/2009 |

* cited by examiner

WATCH CASE WITH MOBILE HORNS

RELATED APPLICATION

This application claims priority to Swiss Application No. CH01090/17 filed Sep. 1, 2017. The entire contents of this application is hereby incorporated by reference.

TECHNICAL FIELD

The present invention concerns a watch case with mobile horns.

STATE OF THE ART

Watch cases for wrist-watches comprise more often than not a middle provided with two pairs of horns in order to fasten the two strands of a bracelet.

The middles are generally constituted of a single part manufactured by stamping while integrating the horns. The presence of the horns makes the case difficult to manufacture and polish.

Each strand of the bracelet is connected to the watch case by a spring bar which passes through a hole at the end of the bracelet and which slot into small holes on the inner side of the two horns of a pair. The length of the bar can be reduced to fit into these holes, then it takes its initial length when it is in situ, which makes it possible to hold the bracelet. These rods are fragile and delicate to insert.

In order to facilitate the insertion of the strands, CH697598B proposes a device for locking the ends of the bracelet bars by means of a sliding latch under the lower side of the horns. This device is fragile.

CH698787 describes a device for locking the ends of the bracelet bars thanks to a rotating bezel that covers the horns in locked position. This device monopolizes the bezel for this function.

FR3004898B1 describes a watch case comprising horns mounted on a strap surrounding the middle. The bracelet can be inserted by opening the strap to temporarily enlarge the lug distance.

Furthermore, watch cases are known in which the middle and the horns are manufactured separately and assembled one to the other afterwards. These cases are easier to manufacture. In some models, the horns can be disengaged from the middle to remove the bracelet.

Thus, CH706260 describes a watch case comprising a middle and removable horns. The horns are grouped in two pairs, with each pair holding one of the strands of the bracelet. The two horns of each pair are connected to one another by a connecting part that increases the diameter of the case between 6 o'clock and 12 o'clock.

EP2188676 describes a similar solution, in which the connecting part is held against the middle by means of an elastic element inside the middle.

CH355094 and CH321188 propose a middle provided with housings designed to receive a connecting part of the horns.

EP0400206 describes a middle for wrist-watch whose bracelet is retained to the middle by means of an external part and a locking element.

EP2431825 describes removable horns connected to a middle by using the deformation of protruding elements. This solution based on elastic deformations is fragile.

CH701221 describes a horn-middle connection by means of connections of the mortise and tenon type, with the assembly being held by a peg. The assembly and disassembly are complex.

A similar solution is described in EP1902641.

FR3021128 discloses a wrist-watch with exchangeable horns. The case comprises two horn sets and fastening means with a spring effect. Each set comprises two horns that are integrally united with one another, with the fastening means being pairs of blades. The horn sets can be decoupled by a user by exerting a pressure on the blades.

EP0886196 describes a wrist-watch manufactured from a nut. The nut forms the watch case and is provided with blind recesses, each of which being configured to hold a horn.

WO2004023221 describes a wrist-watch comprising a middle and a removable bracelet. The bracelet is maintained to the middle by a ball-joint connection between the spherical portions of connecting elements integral with the bracelet and which are being housed in recesses provided in the middle.

BRIEF SUMMARY OF THE INVENTION

Generally, the assembly of the horns by means of screw assembly causes reliability problems, with the screws having the tendency to becoming unscrewed. It is possible to glue them, but this obviously prejudice any possibility of quickly disassembling and reassembling the horns to replace the bracelet, for example if the users wish to change the colour themselves.

The other fastening means described require either specific tools for disassembly or reassembly, which the final users will only rarely have, or locking mechanisms only adapted to thick watch cases with voluminous horns.

One aim of the present invention is to propose a watch case free from the above limitations.

In particular, one aim of the present invention is to propose a watch case with horns that can be disassembled and reassembled easily, without specialized tools, for example to quickly replace a bracelet.

According to the invention, these aims are achieved notably by means of a watch case comprising:

a middle provided with a blind hole;

a first mobile horn for fastening a strand of a bracelet, and provided with a through-hole;

a first elastic element exerting a force on the horn that tends to push it back into a position with a widened lug distance;

a push-button traversing the through-hole and engaged in the blind hole, arranged so as to be able to slide between a locked position, in which the push-button blocks the displacement of the horn, and a released position in which the displacement of the horn into a pushed-back position is possible, a second elastic element exerting a force on the push-button to push it back into the locked position.

This solution has notably the advantage of allowing a facilitated insertion or extraction of the bracelet strands, simply by actuating a push-button in order to widen the lug distance, i.e. the distance between two horns.

The push-button can be actuated directly with the finger, or preferentially with a fine point such as the tip of a pen or any other easily available utensil. Using a fine point limits the risk of involuntary or malicious opening.

The bracelet strand held between two horns by means of a bar for example can be inserted or removed easily, without having to modify the length of the bar.

An auxiliary aim of the invention is to allow a stable fastening of the horns but without requiring voluminous horns or middles.

In particular, one aim is to avoid connecting the horns in pairs at 6 o'clock and at 12 o'clock by means of a connecting part or portion between the two horns of each pair. Such a part increases the diameter of the case between 6 o'clock and 12 o'clock and makes it less adapted to small wrists.

To this effect, the horns of the watch case according to the invention are advantageously connected two-by-two by means of a connecting portion, so as to form two pairs of horns to make easier their stable fastening. However, a first strand of bracelet is held between a first horn of the first pair and a first horn of the second pair, whilst the second bracelet strand is held between the second horn of the first pair and the second horn of the second pair.

The two pairs of horns thus form a cradle surrounding the middle. The mass center of one of the pairs is at 3 o'clock whilst the mass center of the other pair is at 9 o'clock.

BRIEF DESCRIPTION OF THE FIGURES

Examples of embodiments of the invention are indicated in the description illustrated by the attached figures in which.

EXAMPLE(S) OF EMBODIMENTS OF THE INVENTION

Figure 1:
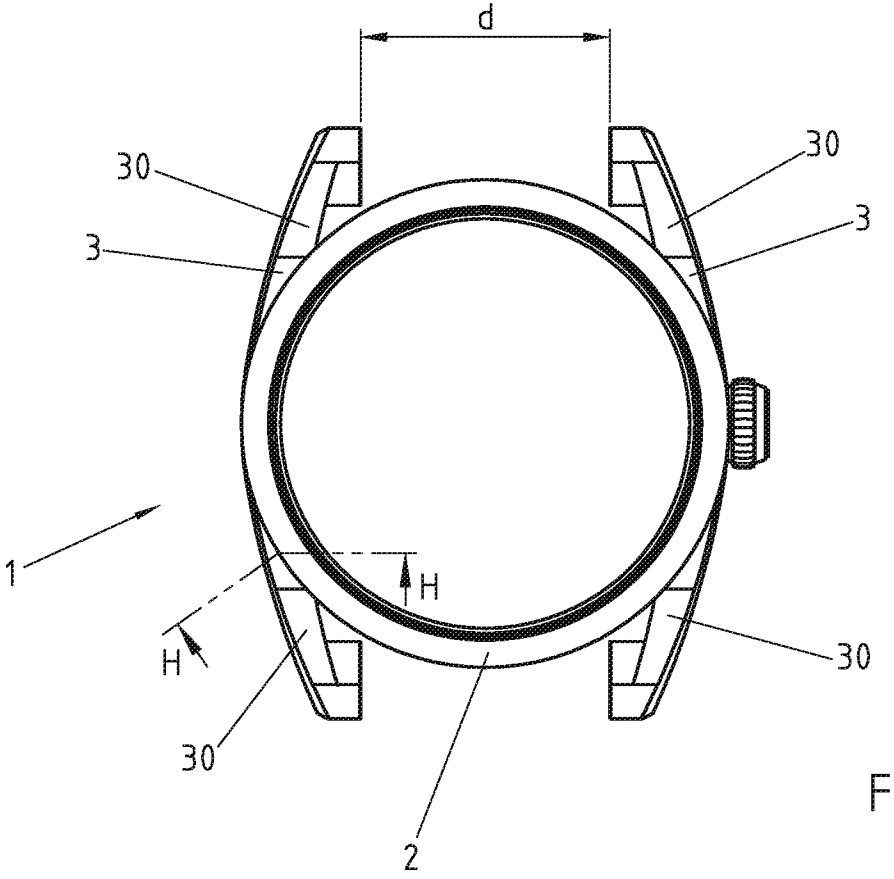
FIG. 1 illustrates a top view of a watch case according to the invention.
Figure 2B:
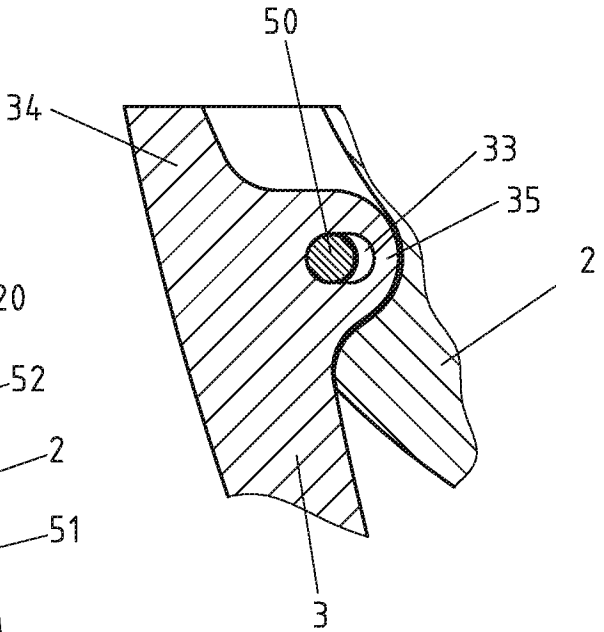
FIG. 2B illustrates a horizontal cross-section view of the watch case in locked position.
Figure 2A:
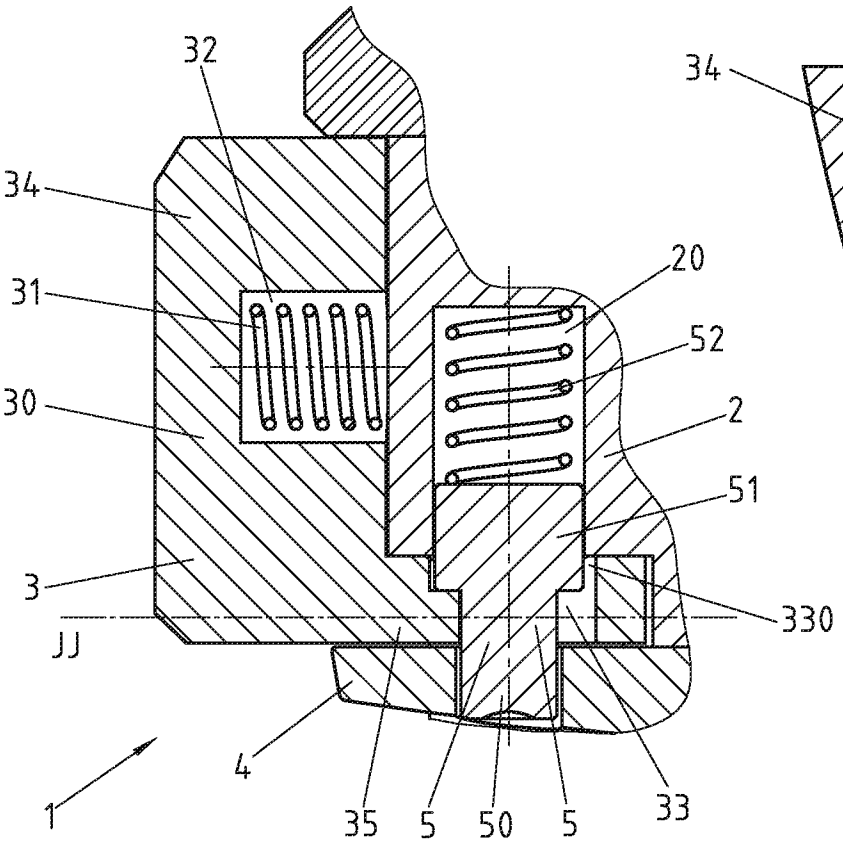
FIG. 2A illustrates a cross-section view along the line H-H of the watch case in locked position.

An example of watch case 1 according to the invention is illustrated in a top view in FIG. 1. The watch case 1 comprises a middle 2, here a cylindrical middle, and two pairs of horns 3 forming a cradle. It is preferably provided with a removable bottom 4, as illustrated in FIGS. 2A and 2B.

The first pair of horns, on the left in the figure, comprises a first horn (approximately at 11 o'clock) for holding a first side of the first strand of the bracelet, and a second horn (approximately at 7 o'clock) for holding a first side of the second strand of the bracelet. The two horns of the first pair are connected to one another by a connecting portion surrounding the left of the middle as seen from above. The center of gravity of this pair of horns is thus at 9 o'clock.

The second pair of horns, on the right in the figure, comprises a first horn (approximately at 1 o'clock) for holding a second side of the first strand of the bracelet, and a second horn (approximately at 5 o'clock) for holding a second side of the second strand of the bracelet. The two horns of the second pair are connected to one another by a connecting portion surrounding the right of the middle as seen from above. The center of gravity of this pair of horns is thus at 3 o'clock.

The first bracelet strand (not illustrated) is held between the first horn of the first pair and the first horn of the second pair. The gap between the two horns at rest is indicated by the reference d. The second bracelet strand (not illustrated) is held between the second horn of the first pair and the second horn of the second pair. The gap between the two horns at rest is preference also equal to d.

Each bracelet strand can be held by a non-extensible bar traversing the extremity of the bracelet and inserted into two blind holes on the inside face of two opposite horns. The bars do not need to be extensible and the insertion or extraction are performed by temporarily widening the lug distance d, as will be seen. The bars can be round-section bars or preferably bars of a shape for imposing the direction in which the bracelet strand is directed.

Figure 3B:
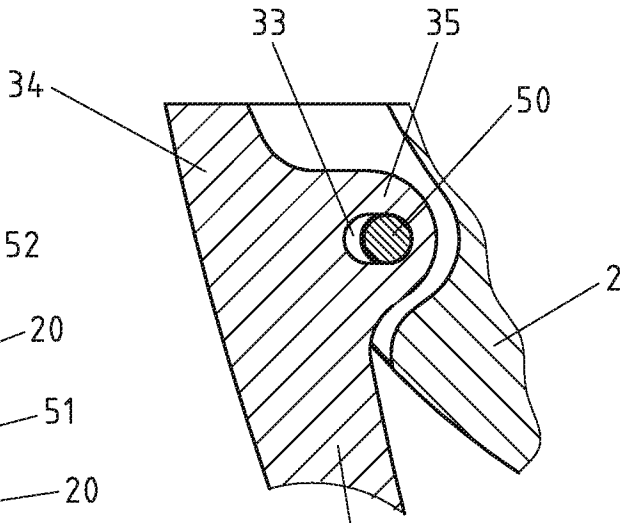
FIG. 3B illustrates a horizontal cross-section view of the watch case in released position.
Figure 3A:
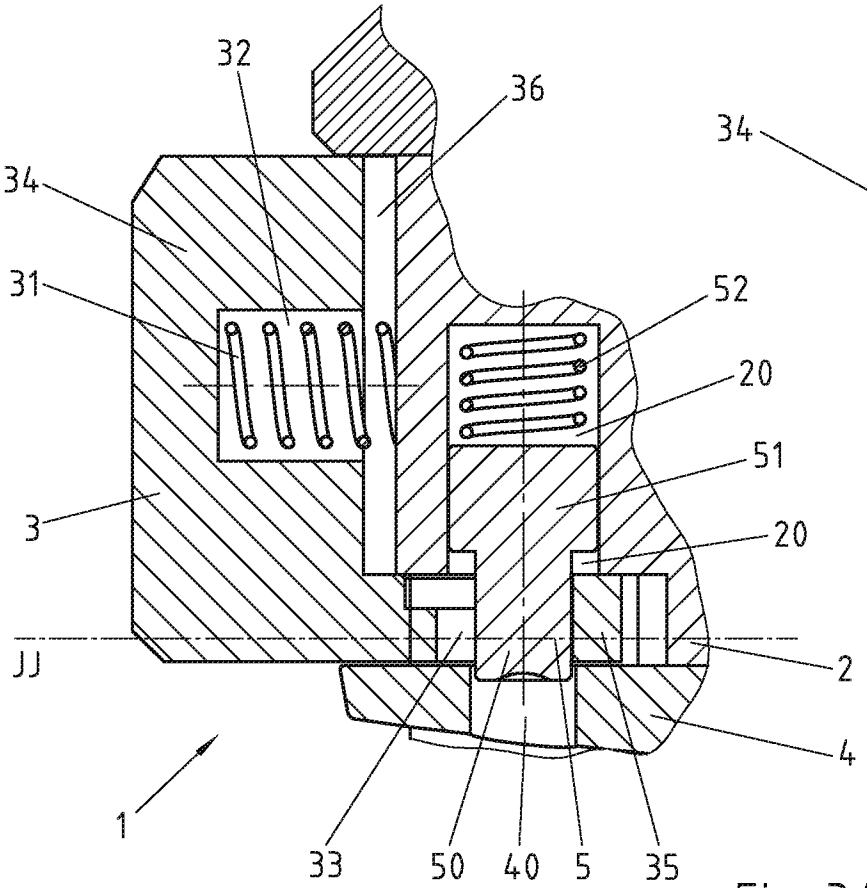
FIG. 3A illustrates a cross-section view along the line H-H of the watch case in released position.

FIG. 2A shows a cross-section view of the watch case in the horns' locked position, along the line H-H of FIG. 1; FIG. 2B shows the same case in cross-section along the line J-J of FIG. 2A. Corresponding views in the horns' released position are illustrated in FIGS. 3A and 3B.

Each horn or each pair of horns comprises a blind hole 32 for housing a first elastic element 31, preferably a balance spring, which tends to push back the horn 30 away from the middle 2, in an essentially radial direction. It is possible to provide a spring 31 per horn, or one per pair of horns 3. The horns 3 comprise a portion 34 that extends radially to hold the bracelet, and a portion 35 that extends under the middle 2, or between the middle 2 and the bottom 4. The first elastic element can also be housed in a blind hole in the middle, or be made in the form of a blade between the horn and the middle. It is also possible to use an elastomer as first elastic element.

In the locked position illustrated in FIGS. 2A and 2B, the movement of the horn 30 is held by the push-button 5 engaged in the through-hole 33 under the horn and in the blind hole 20 under the middle. In the example illustrated, this push-button also traverses the bottom 4. A second elastic element 52, preferably a balance spring, is housed in this blind hole 20 and tends to push back the push-button out of this blind hole, towards the bottom of FIG. 2A.

Independently of the number of springs 31, it is possible to provide an assembly push-button 5/spring 52 per horn 30, or such an assembly per pair of horns 3.

Each push-button 5 comprises a push-button head 51 and a push-button rod 50. The diameter of the push-button head 51 is greater than the diameter of the push-button rod 50 and prevents the push-button from coming out after assembly.

The elastic element 52 rests against the push-button head 51 that is at least partially engaged in the blind hole 20. The push-button rod 50 traverses the hole 33 through the portion 35 of the horns under the middle 2.

The through-hole 33 has an oblong shape and thus enables the horn 3 to move in an approximative direction relative to the push-button 5 and thus to the middle 2. In FIGS. 2A and 2B, the horn 3 rests against the outer flank of the middle. In FIGS. 3A and 3B, the horn 3 is pushed back radially by the elastic element 31, leaving a play 36 between the outer flank of the middle 2 and the inner flank of the horn. In this position, the lug distance is widened, which allows a rod to be inserted between two horns in order to fasten there a bracelet strand.

In the locked position illustrated in FIGS. 2A and 2B, the movement of the horn 3 is prevented by a portion of the push-button head 51, which is pushed back into the through-hole 33 by the elastic element 52. The small play 330 visible in FIG. 2A exists in the cross-section plane, but not in the horn's movement plane.

By pushing the push-button 5 against the action of the elastic element 52, for example by means the tip of a tool or pen from the bottom of the watch, the head 51 penetrates entirely in the blind hole 20 through the middle 2, which releases the horn as illustrated in FIGS. 3A and 3B. It can then move outwards, creating a play 36 between the middle 2 and the horn 30. The amplitude of the movement is limited by the contact between the edge of the through-hole 33 and the rod 50.

The horn 3 can be put back into locked position by pressing on its outer side until the push-button head 51 can return into the through-hole 33 under the action of the second elastic element 52.

Independently of the presence of a push-button and of the way in which the pairs of horns are fastened to the middle, the wrist-watch includes a bracelet provided with electronic elements, for example a battery, a processor, an inertial sensor, a GPS sensor and/or an RF circuit etc. These components can be for example embedded in an overmolded bracelet of rubber or synthetic material. An electric connection can be established between the components of this bracelet and a conductor housed in the horns, for example through the bar. The bar can be made of two parts electrically insulated from one another.

The horn 30 can be made for example of an insulating material, for example a synthetic or ceramic material, in order to house a conductor wire connected to the bar when the bracelet is mounted in locked position. The horn can also be made of a conductor material, for example of metal, and house one or several conductors provided with an insulating peripheral sheath. The wire can go through a hole in the horn that can be machined. In one variant, the hole is provided in one horn made by assembly, or made by additive manufacturing, for example MIME or 3D impression. One of the horns can serve directly as conductor, for example a ground conductor, without requiring an insulated conductor.

The electric connection between a bracelet strand and the two horns that hold this strand can allow an electronic component of the bracelet to be powered with the watch battery, or inversely a circuit in the watch can be powered with a battery in the bracelet strand.

In another embodiment, the electric connection between a bracelet strand and the two horns 30 that hold this strand allows an electric power signal to be transmitted between the two bracelet strands, going through the connecting portion of each of the two pairs of horns. One of the pairs of horns can for example transmit the mass of the electric signal between the two bracelet strands; the second pair of horns can transmit a continuous electrical power signal $V_{dd}$ between these two strands. This arrangement enables a bracelet to be made whose two strands are provided with electronic components, both powered by a battery or an electric energy source in one of the two strands.

REFERENCE NUMBERS USED IN THE FIGURES

1 Watch case
2 Trou borgne dans la carrure
20 Pair of horns
3 Horn
31 First elastic element
32 Blind hole in the horn
33 Through-hole
330 Play subsisting in the cross section plane
34 Portion of the horns extending radially
35 Portion of the horns under the middle
36 Play
4 Bottom
5 Push-piece
50 Push-piece rod
51 Push-piece head
52 Second elastic element

The invention claimed is:

1. Watch case comprising:
a middle provided with a blind hole;
at least one mobile horn for fastening at least one strand of a bracelet, and provided with a through-hole;
a first elastic element exerting a force on the horn that tends to push it back into a position with a widened lug distance;
a push-button traversing said through-hole and engaged in the blind hole in the middle, arranged so as to be able to slide between a locked position, in which the push-button blocks the displacement of the horn, and a released position in which the displacement of the horn into a pushed-back position is possible,
a second elastic element exerting a force on the push-button to push it back into the locked position.

2. Watch case according to claim 1, wherein the push-button comprises a head with a first diameter and a rod with a second diameter smaller than the first diameter,
with the locked position corresponding to the push-button head engaging in the through-hole,
with the released position corresponding to the push-button rod engaging in the through-hole.

3. Watch case according to claim 2, wherein the second elastic element is engaged at the bottom of the blind hole in the middle, so as to push back the push-button towards the outside of this blind hole.

4. Watch case according to claim 3, wherein the push-button head is turned towards the bottom of the blind hole in the middle, with the push-button rod being turned towards the opening of this blind hole.

5. Watch case according to claim 1, wherein the push-button ends up under an inner side of the middle.

6. Watch case according to claim 1, comprising four horns fastened two-by-two so as to form two pairs of horns around the middle,
arranged so as to hold a first bracelet strand between a first horn of the first pair and a first horn of the second pair,
and a second bracelet strand between the second horn of the first pair and the second horn of the second pair.

* * * * *